US010088163B2

(12) United States Patent
Beck et al.

(10) Patent No.: US 10,088,163 B2
(45) Date of Patent: Oct. 2, 2018

(54) JET BURNER WITH COOLING DUCT IN THE BASE PLATE

(71) Applicant: Siemens Aktiengesellschaft, Munich (DE)

(72) Inventors: Christian Beck, Essen (DE); Simon Bez, Heidelberg (DE); Bjorn Buchholz, Dinslaken (DE); Thomas Grieb, Krefeld (DE); Matthias Hase, Mulheim (DE); Werner Krebs, Mulheim an der Ruhr (DE); Berthold Kostlin, Duisburg (DE); Stefan Reich, Dusseldorf (DE); Marc Tertilt, Hattingen (DE); Jan Wilkes, Lubeck (DE)

(73) Assignee: Siemens Aktiengesellschaft, Munich (DE)

( * ) Notice: Subject to any disclaimer, the term of this patent is extended or adjusted under 35 U.S.C. 154(b) by 271 days.

(21) Appl. No.: 14/773,345

(22) PCT Filed: Feb. 7, 2014

(86) PCT No.: PCT/EP2014/052410
§ 371 (c)(1),
(2) Date: Sep. 6, 2015

(87) PCT Pub. No.: WO2014/139738
PCT Pub. Date: Sep. 18, 2014

(65) Prior Publication Data

US 2016/0018109 A1 Jan. 21, 2016

(30) Foreign Application Priority Data

Mar. 13, 2013 (DE) ..... 10 2013 204 307

(51) Int. Cl.
*F23R 3/10* (2006.01)
*F23R 3/00* (2006.01)
(Continued)

(52) U.S. Cl.
CPC ..... *F23R 3/005* (2013.01); *F23R 3/002* (2013.01); *F23R 3/04* (2013.01); *F23R 3/10* (2013.01);
(Continued)

(58) Field of Classification Search
CPC .. F23R 3/005; F23R 3/002; F23R 3/04; F23R 3/10; F23R 3/286; F23R 3/343;
(Continued)

(56) References Cited

U.S. PATENT DOCUMENTS 3,854,285 A * 12/1974 Stenger ..... F23R 3/50 60/756
4,707,982 A 11/1987 Wagner
(Continued)

FOREIGN PATENT DOCUMENTS

CN 1032230 A 4/1989
EP 0335978 A1 10/1989
(Continued)

*Primary Examiner* — Steven Sutherland
(74) *Attorney, Agent, or Firm* — Beusse Wolter Sanks & Maire

(57) ABSTRACT

A jet burner has a hot-gas side, which faces toward a combustion chamber during operation, and a cold-gas side, which faces away from a combustion chamber, including a base plate on which there are arranged multiple jet nozzles, wherein the base plate has at least one cooling duct, wherein the at least one cooling duct issues into a burner stage which comprises a pilot burner arranged on the base plate.

19 Claims, 4 Drawing Sheets

(51) Int. Cl.
*F23R 3/28* (2006.01)
*F23R 3/34* (2006.01)
*F23R 3/04* (2006.01)

(52) U.S. Cl.
CPC ..... *F23R 3/286* (2013.01); *F23R 3/343* (2013.01); *F23R 2900/03043* (2013.01); *F23R 2900/03045* (2013.01); *F23R 2900/03282* (2013.01)

(58) Field of Classification Search
CPC .. F23R 2900/03043; F23R 2900/03045; F23R 2900/03282
See application file for complete search history.

(56) References Cited

U.S. PATENT DOCUMENTS 4,930,703 A 6/1990 Ford et al.
5,161,379 A 11/1992 Jones et al.
5,197,289 A * 3/1993 Glevicky ..... F23R 3/04 60/746
5,339,635 A 8/1994 Iwai et al.
5,361,586 A * 11/1994 McWhirter ..... F23D 14/02 60/737
5,490,389 A 2/1996 Harrison et al.
5,765,376 A * 6/1998 Zarzalis ..... F23R 3/10 60/748
5,782,294 A * 7/1998 Froemming ..... F01D 5/288 165/168
6,098,397 A * 8/2000 Glezer ..... F23R 3/002 60/752
7,971,439 B2 * 7/2011 Commaret ..... F02C 3/14 60/752
2002/0005274 A1 1/2002 Beeck et al.
2003/0221429 A1 12/2003 Laing
2004/0025508 A1 * 2/2004 Calvez ..... F23R 3/14 60/746
2005/0047932 A1 * 3/2005 Nakae ..... F23R 3/002 417/313
2008/0016874 A1 1/2008 Markarian et al.
2008/0115506 A1 5/2008 Patel et al.
2010/0269509 A1 10/2010 Harris, Jr. et al.
2010/0300104 A1 12/2010 Bottcher
2013/0029277 A1 1/2013 Koizumi et al.

FOREIGN PATENT DOCUMENTS

EP 1114976 A2 7/2001
EP 2187125 A1 5/2010
EP 2436983 A1 4/2012
EP 2442029 A1 4/2012
EP 2551596 A2 1/2013
WO 9964791 A1 12/1999

* cited by examiner

JET BURNER WITH COOLING DUCT IN THE BASE PLATE

CROSS REFERENCE TO RELATED APPLICATIONS

This application is the US National Stage of International Application No. PCT/EP2014/052410 filed 7 Feb. 2014, and claims the benefit thereof. The International Application claims the benefit of German Application No. DE 102013204307.4 filed 13 Mar. 2013. All of the applications are incorporated by reference herein in their entirety.

FIELD OF INVENTION

In modern gas turbine combustion systems, local hot gas temperatures exceed the currently permissible temperature limits of superalloys with thermal barrier layers, such that additional cooling is required.

The invention therefore relates to the cooling of the nozzle support of a jet burner.

BACKGROUND OF INVENTION

Jet-stabilized combustion systems, in which the fuel is combusted in a jet flame downstream of the burner, have a simple premix zone in comparison to swirl-stabilized systems. Since the pressure difference in the burner is converted exclusively into the axial velocity component, these burners are distinguished by a lower tendency to flashback, for which reason it is also possible to use this burner for combusting more highly reactive combustion mixtures having a higher hydrogen fraction.

Furthermore, jet-stabilized combustion systems generate no swirl-induced turbulence structures which can cause flame instabilities. Such a jet-stabilized combustion system is disclosed for example in US 2010/0300104 A1. In order to accommodate the premix passages, what is termed a nozzle carrier (also "jet carrier") is required which, depending on the design, has a different number of nozzles which can be arranged concentrically on one or more rings.

The nozzle carrier is conventionally made of solid forged material which is very expensive but is advantageous for the prototype design since this means it is comparatively simple to produce. Furthermore, no cooling is required on the hot gas side of the nozzle carrier on account of good mechanical properties and good heat transfer between air in the nozzle carrier and the nozzle carrier itself.

Since the nozzle carrier is currently produced by forging using for example a nickel alloy, machining the required bores is onerous, the construction is solid and thus also the weight is high, furthermore the shape of the component is limited by the production method. Consequently, the component is very expensive to manufacture and some component properties cannot be realized. At least, it is very onerous to introduce additional features or particularities, such as cooling air ducts or purge air ducts, into the nozzle carrier.

In addition, mass production cannot be envisaged on account of the costs.

SUMMARY OF INVENTION

The object of the invention is to refine the mentioned jet burner such that it is possible to minimize production costs and to integrate additional design features which have a positive effect on operation of the combustion system.

According to the invention, this object is achieved by the apparatus as claimed in the independent claim. Advantageous developments of the invention are defined in the dependent claims. A jet burner having a hot gas side which, in operation, is oriented toward a combustion chamber and a cold gas side which is oriented away from the combustion chamber, comprising a base plate on which there are arranged multiple jet nozzles, wherein the base plate has at least one cooling duct, the at least one cooling duct opens into a burner stage which comprises a pilot burner arranged on the base plate achieves that the current nozzle carrier can be manufactured much more cost-effectively than in the case of a solid construction.

Only by using active cooling is it possible to use a more cost-effective material for the nozzle carrier in order to compensate for the mechanical load-bearing ability lost as a consequence of the lighter construction. In that context, the cooling duct can be one of many cooling ducts, or can also be a type of cavity which extends over almost the entire surface of the base plate and through which the cooling air flows.

Active cooling, for example by means of effusion cooling, has a negative influence on NOx emissions since the mass flow rate of air to the flame front is reduced. This causes a local increase in the flame temperature and thus in the NOx emissions. This is avoided, according to the invention, by the fact that the at least one cooling duct opens into a burner stage, such that cooling air is no longer simply discharged into the combustion chamber.

In that context, it is important that the burner stage comprises a pilot burner arranged on the base plate. This can namely be operated with a lower pressure loss than the jet nozzles of the main burner.

It is in particular advantageous if the burner stage includes a pilot burner arranged on the base plate and the air required for operation of the pilot burner can be supplied from the cooling duct, i.e. if the pilot burner is supplied with the necessary air directly and exclusively via the cooling duct and an even mass flow rate of air to the flame front is ensured.

It is advantageous if the base plate has on its hot gas side a thermal barrier coating, whereby it is possible to lower the material temperature and/or the cooling requirement during operation of the burner.

In one advantageous embodiment of the invention, the at least one cooling duct can be charged with cooling air via an opening on a circumferential rim of the base plate.

In one alternative advantageous embodiment of the invention, the at least one cooling duct can be charged with cooling air via an opening on the cold gas side of the base plate.

In a further advantageous embodiment of the invention, the at least one cooling duct can be charged via a cooling air line which is arranged in a wall surrounding the jet nozzles and adjoining the base plate, and which is open toward the cold gas side of the jet burner and opens into the base plate.

If the cooling duct takes the form of a type of cavity, it is possible for wake regions to form behind the premixed passengers around which the cooling air flows. In these regions, the transfer of heat and/or the cooling of the base plate by means of the cooling air is reduced. In order to avoid or at least minimize wake regions behind the jet nozzles, it is possible to introduce into the flow path elements for increasing heat transfer and/or for flow guiding. For example, the cooling duct in the base plate can have spoilers or swirl generators such as ribs or relatively small dimples.

In one advantageous embodiment, at least the base plate is a cast part. The limitations, caused by the forging method according to the prior art, can be minimized by using a casting process to give the original shape of the nozzle carrier. The use of this process makes it possible to produce a near-net shape blank which requires only minor machining to have its final contours. For example, it is possible for bores to be created already in the casting process by means of the use of cores, which saves both volume and mass. Furthermore, the casting method makes it possible to create more complex geometries. It is thus possible to introduce additional functions into the component and thus to improve the component properties. The flexibility in terms of the component geometry, which is made possible by means of the casting process, could, if the cooling is sufficiently optimized, lower the operating temperature of the component to the point that a more cost-effective cast steel material can be used instead of a nickel-based alloy. Furthermore, the component can be configured in a manner that is appropriate to the loads to which it is to be subjected.

Advantageously, the cast part further comprises the jet nozzles which form the main burner. These can be cast directly at the same time as casting the base plate.

In an alternative embodiment, the base plate is a sheet metal construction. This solution also makes it possible to reduce production costs in comparison to the variant with solid forged material, merely by virtue of substantially lower raw material costs.

In particular, but not exclusively, in the case of a sheet metal construction, it is advantageous if a circumferential wall extending beyond the cold gas side of the base plate approaches a central axis of the jet burner with increasing distance from the base plate. This wall and the—typically cylindrical—outer casing part surrounding it then form a type of diffuser, which slows the airflow provided by the compressor and advantageously increases the pressure.

In the jet burner according to the invention, the air supply for the pilot burner and for the main burner are separate. It is thus possible for the mass flow rate of air for the pilot burner to be used for cooling the burner. By manufacturing the jet burner according to the invention by casting or by using a sheet metal construction, it is possible not only to reduce costs, but also to introduce into the nozzle carrier additional design features which have a positive effect on the operation of the combustion system (e.g. improved service life, increased flashback safety and lower pressure loss). These positive properties are achieved in the present invention by means of the introduction of cooling air ducts and purge air ducts.

BRIEF DESCRIPTION OF THE DRAWINGS

The invention will be explained in more detail by way of example with reference to the drawings, which are schematic and not to scale, and in which.

DETAILED DESCRIPTION OF INVENTION

Figure 1:
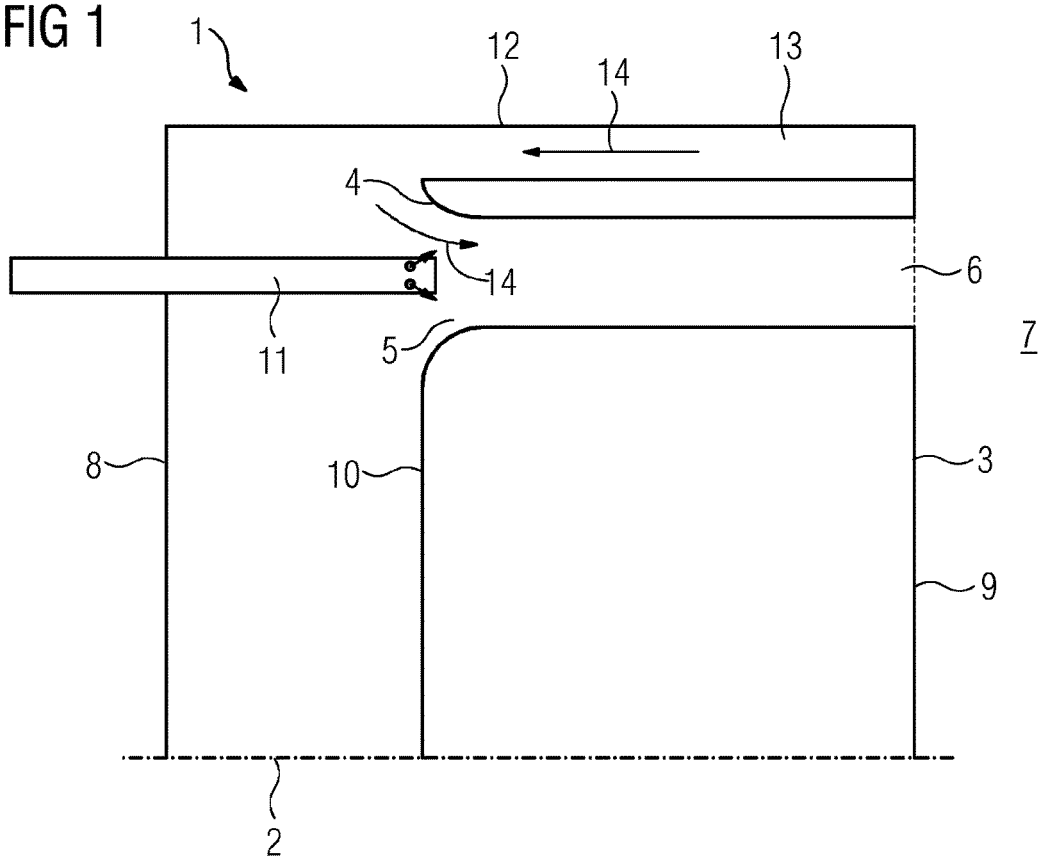
FIG. 1 shows a jet burner according to the prior art.

FIG. 1 shows schematically a section through a part of a jet burner 1 in the longitudinal direction, that is to say along the central axis 2 of the burner 1 according to the prior art. The burner 1 has at least one jet nozzle 4 arranged in a nozzle carrier 3. The jet nozzle 4 comprises a jet nozzle inlet 5 and the jet nozzle outlet 6. The combustion chamber 7 adjoins the jet nozzle outlet 6. In addition, the jet nozzle 4 is arranged in the nozzle carrier 3 such that the jet nozzle inlet 5 is oriented toward the rear wall 8 of the burner 1. That side of the jet burner 1 which is oriented toward the combustion chamber 7 is termed the hot gas side 9; the side oriented away from the combustion chamber 7 is termed the cold gas side 10. A fuel nozzle 11 is arranged in the region of the jet nozzle inlet 5 of the jet nozzle 4. Fuel is injected into the jet nozzle 4 through the fuel nozzle 11. The burner 1 further comprises a radially—with respect to the central axis 2 of the burner 1—outer casing part 12 which, with the nozzle carrier 3, forms an annular duct 13. Air 14 from the compressor flows through this annular duct 13 toward the rear wall 8 of the burner 1 where it is deflected, such that it passes through the jet nozzle inlets 5 into the jet nozzles 4.

What FIG. 1 does not show is that burners, in particular premix burners such as the jet burner 1 shown, can be equipped with an additional pilot burner in order to ensure stable combustion over a broad operating range, in particular under zero load and partial load. Such a pilot burner is then typically arranged on the central axis 2 of the burner.

Figure 2:
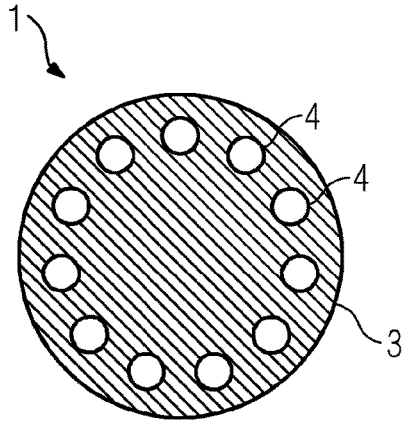
FIG. 2 shows a section through a jet burner perpendicular to a central axis of the burner.

FIG. 2 shows, schematically, a section through a jet burner 1 perpendicular to a central axis 2 of the burner 1. The nozzle carrier 3 has a circular cross section. A certain number of jet nozzles 4 is arranged, in essentially annular fashion, within the nozzle carrier 3. In that context, each jet nozzle 4 has a circular cross section.

Figure 3:
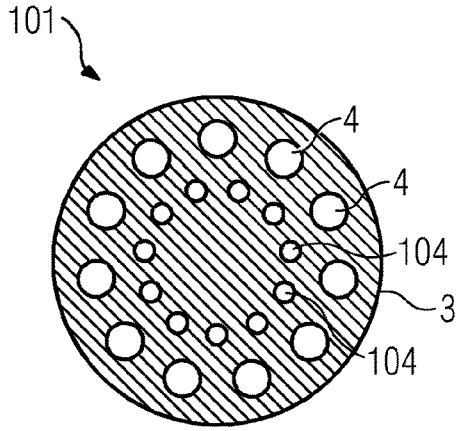
FIG. 3 shows a section through a further jet burner perpendicular to a central axis of the burner.

FIG. 3 shows, schematically, a section through a jet burner 101, wherein the section runs perpendicular to the central axis of the burner 101. The burner 101 also has a nozzle carrier 3, which has a circular cross-section and in which there is arranged a number of inner and outer jet nozzles 4, 104. The jet nozzles 4, 104 each have a circular cross-section, wherein the cross section area of the outer jet nozzles 4 is equal to or larger than that of the inner jet nozzles 104. The outer jet nozzles 4 are arranged in essentially annular fashion within the nozzle carrier 3 and form an outer ring. The inner jet nozzles 104 are also arranged in annular fashion within the nozzle carrier 3. The inner jet nozzles 104 form an inner ring which is arranged concentric with the outer jet nozzle ring.

FIGS. 2 and 3 merely show examples for the arrangement of jet nozzles 4, 104 within a jet burner 1, 101. Alternative arrangements are of course also possible, as is the use of a different number of jet nozzles 4, 104. In addition, the burner 1, 101 can comprise a pilot burner.

Figure 4:
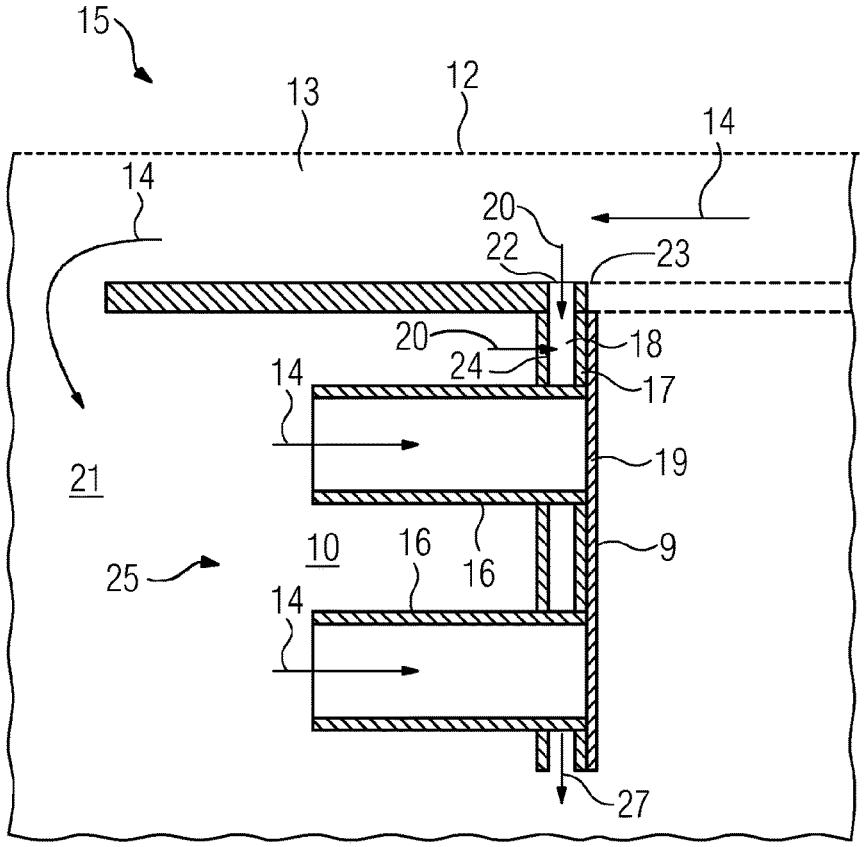
FIG. 4 shows a section through a part of a jet burner according to the invention with possibilities for drawing cooling air.

FIG. 4 shows a section through a part of a jet burner 15 according to the invention, in which the jet nozzles 16 are arranged on a base plate 17, wherein the base plate 17 has cooling ducts 18 that can for example be cast directly in the base plate 17 when use is made of a casting process. It is then also possible for the jet nozzles 16, which form the main burner (premix burner) to be directly cast at the same time. The base plate 17 is cooled via the cooling air ducts 18.

On the hot gas side, the base plate 17 can be complemented by a thermal barrier coating 19. By virtue of the combination of thermal barrier coatings 19 and effective cooling, it is possible under certain circumstances to do without, for example, nickel-based alloys. However, even when a nickel-based alloy is used, a reduction in costs is to be expected since substantially less material is necessary for a cast part.

As further represented in FIG. 4, the cooling air 20 can be drawn either from the annular duct 13 or from the plenum 21 upstream of the base plate 17. When drawing from the annular duct 13, the cooling air 20 is fed to the cooling duct 18 via openings 22 on a circumferential rim 23 of the base plate 17. When drawing from the plenum 21, the cooling air 20 is fed to the cooling duct 18 via openings 24 on the cold gas side 10 of the base plate 17. After cooling the base plate 17, the cooling air 20 does not pass directly into the combustion chamber 7 but is fed to the pilot burner (cf. FIG. 6).

Figure 7:
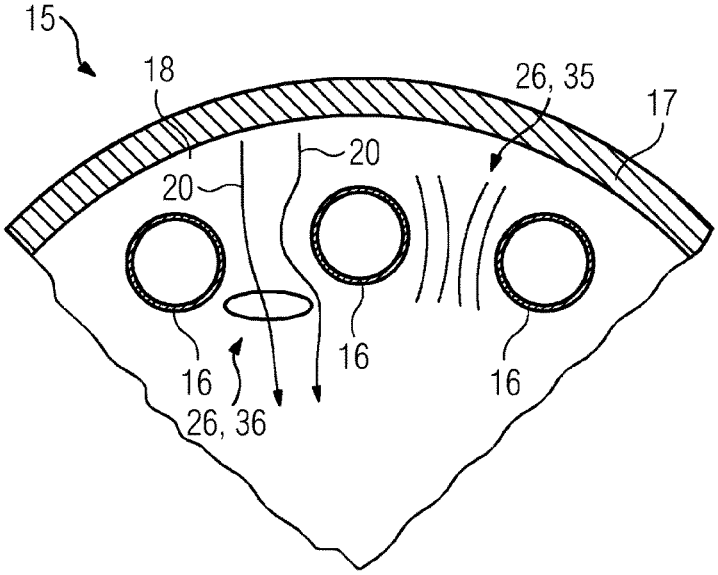
FIG. 7 shows a section through a jet burner according to the invention, perpendicular to the central axis, with a view into the cavity.

As a consequence of the high flow speeds in the jet nozzles 16 (substantial drop in static pressure), there is here a strong pressure drop which can be used to equip the cooling ducts 18 with elements 26 for increased heat transfer (e.g. ribs or dimples 36) and/or for flow guiding (e.g. spoilers 35) (cf. FIG. 7).

If the pilot draws the quantity of air required for its operation essentially via the cooling air ducts 18, a relatively high quantity of air is available (approx. 5-12% of the total available quantity of air 14), i.e. the cooling ducts 18 must in this case be accordingly large in order that the desired pilot air split, i.e. that fraction of the air supplied to the pilot with respect to the total quantity of air 14, is also achieved at the predefined differential pressure. In this case, the cooling ducts 18 were equipped with no or only a few ribs or similar elements 26. The required cooling effect is brought about by means of the increased mass flow rate.

Figure 5:
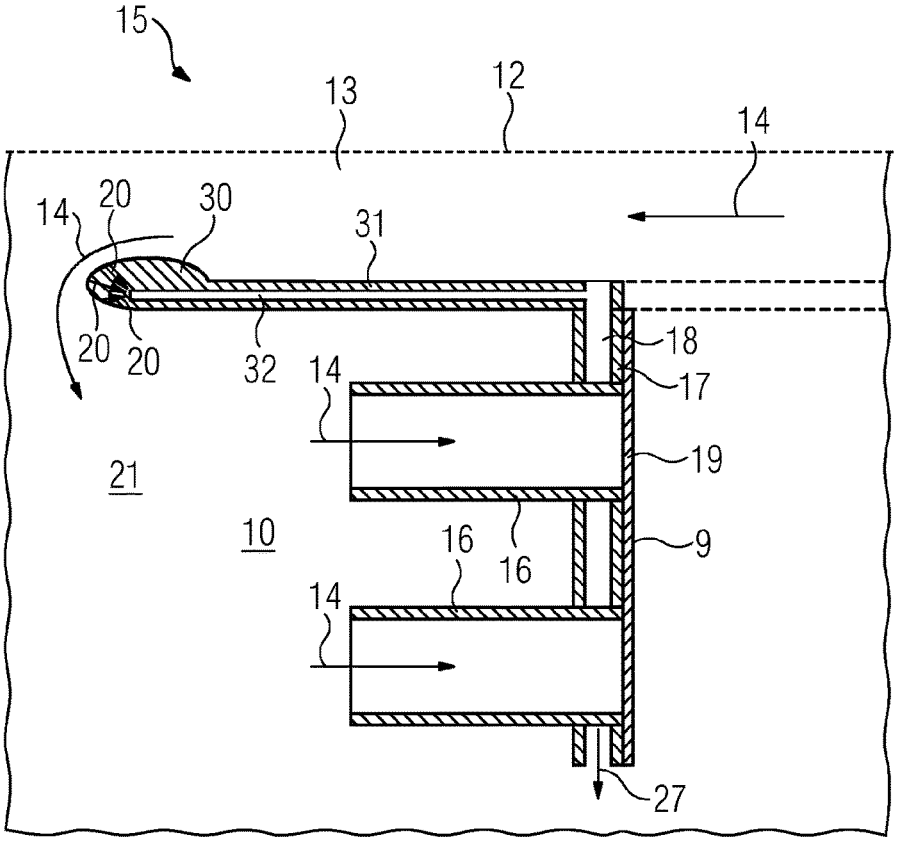
FIG. 5 shows a further possibility for drawing cooling air.

FIG. 5 shows a further possibility for drawing cooling air. In the case shown, the cooling air for the base plate 17 (or at least part of the cooling air) is drawn from the boundary layer at the redirection 30 from the annular duct 13 into the plenum 21. Drawing air in this manner means that the boundary layer is stabilized and remains attached for longer. This results in a lower redirection pressure loss. The pressure gained can be used e.g. for a higher jet velocity. The cooling air 20 passes into the cooling duct 18 of the base plate 17 via a cooling air line 32 which is arranged in the wall 31—surrounding the jet nozzles 16 and adjoining the base plate 17—of the nozzle carrier, is open toward the cold gas side 10 of the jet burner 15 and discharges into the base plate 17.

Figure 6:
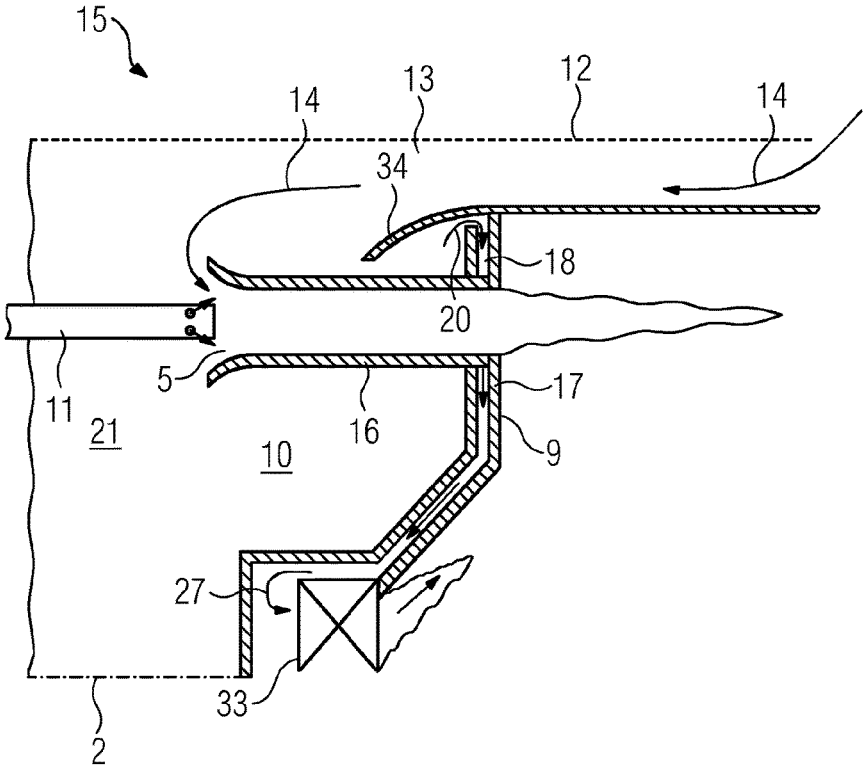
FIG. 6 shows an embodiment of the cooling concept according to the invention, in which air flows through a cooling duct in the form of a cavity

FIG. 6 shows a further embodiment of the cooling concept according to the invention, in which air flows through a cooling duct 18, wherein the cooling duct 18 extends in the manner of a cavity approximately over the entire surface of the base plate 17 and wherein the cooling air 20, after flowing through the cooling duct 18, is supplied to the pilot burner 33 as pilot air 27. In this case, the pilot burner 33 is supplied with air directly and exclusively via the cooling duct 18.

The circumferential wall 34, which extends beyond the cold gas side 10 of the base plate 17, approaches a central axis 2 of the jet burner 15 with increasing distance from the base plate 17. This wall 34 and the—typically cylindrical—outer casing part 12 surrounding it then form a type of diffuser, which slows the airflow 14 provided by the compressor and the pressure advantageously increases.

FIG. 7 shows a section, perpendicular to the central axis 2, through a jet burner 15, according to the invention, which can advantageously be created by means of a sheet metal construction since the cooling duct 18 extends essentially over the base area of the base plate 17, where relevant interrupted only by supporting elements. In the present example of FIG. 7, the cooling air 20 is guided from radially outside to radially inside between the hot gas side 9 and the cold gas side 10 of the base plate 17 (the pilot burner is not shown). In that context, the cooling air 20 flowing inward to the pilot must flow around the jet nozzles 4 of the premixed passages of the main burner 25.

In order to avoid or at least minimize wake regions behind the jet nozzles 4, it is possible to introduce into the flow path elements 26 for increasing heat transfer and/or for flow guiding, as shown in FIG. 7 with the spoilers 35 or dimples 36.

The invention claimed is:

1. A jet burner comprising a hot gas side which, in operation, is oriented toward a combustion chamber and a cold gas side which is oriented away from the combustion chamber, the jet burner comprising:

a base plate on which there are arranged multiple jet nozzles, wherein the base plate comprises at least one cooling duct which opens into a burner stage that comprises a pilot burner arranged on the base plate, wherein the at least one cooling duct extends over an entire surface area of the base plate, such that cooling air is adapted to be guided through the at least one cooling duct from radially outside to radially inside between a hot gas side of the base plate and a cold gas side of the base plate and such that the cooling air is adapted to flow around the multiple jet nozzles, wherein the at least one cooling duct opens only to the pilot burner, and wherein the at least one cooling duct is adapted to be fed with the cooling air via an opening on the cold gas side of the base plate.

2. The jet burner as claimed in claim 1, wherein the burner stage comprises the pilot burner arranged on the base plate and air required for operation of the pilot burner is adapted to be supplied from the at least one cooling duct.

3. The jet burner as claimed in claim 1, wherein the base plate comprises on its hot gas side a thermal barrier coating.

4. The jet burner as claimed in claim 1, wherein the at least one cooling duct is adapted to be fed with the cooling air via an opening on a circumferential rim of the base plate.

5. The jet burner as claimed in claim 1, wherein the at least one cooling duct is adapted to be fed with the cooling air via a cooling air line which is arranged in a wall surrounding the multiple jet nozzles and adjoining the base plate, and which is open toward the cold gas side of the jet burner and opens into the base plate.

6. The jet burner as claimed in claim 1, wherein the at least one cooling duct in the base plate comprises elements for increased heat transfer.

7. The jet burner as claimed in claim 6, wherein the elements comprise ribs or dimples.

8. The jet burner as claimed in claim 6, wherein the at least one cooling duct in the base plate comprises elements for flow guiding.

9. The jet burner as claimed in claim 8, wherein the elements for flow guiding comprise spoilers.

10. The jet burner as claimed in claim 1,
wherein at least the base plate is a cast part.

11. The jet burner as claimed in claim 10,
wherein the cast part comprises jet nozzles.

12. The jet burner as claimed in claim 1,
wherein at least the base plate is a sheet metal construction.

13. The jet burner as claimed in claim 1,
wherein a circumferential wall extending beyond the cold gas side of the base plate approaches a central axis of the jet burner with increasing distance from the base plate.

14. The jet burner as claimed in claim 1, wherein the multiple jet nozzles are arranged in an annular fashion and form an outer ring.

15. The jet burner as claimed in claim 14, wherein each jet nozzle comprises a circular cross-section.

16. A jet burner comprising a hot gas side which, in operation, is oriented toward a combustion chamber and a cold gas side which is oriented away from the combustion chamber, the jet burner comprising:

a base plate on which there are arranged a pilot burner and multiple jet nozzles in an annular fashion about the pilot burner, wherein the base plate comprises a cooling duct, wherein the cooling duct originates at a radially outer side of the base plate and extends radially inward over an entire surface area of the base plate between a hot gas side of the base plate and a cold gas side of the base plate and is configured such that cooling air is adapted to flow around the multiple jet nozzles, and wherein an entirety of the cooling air that enters the cooling duct is delivered to the pilot burner.

17. The jet burner as claimed in claim 16, wherein a circumferential wall extending beyond the cold gas side of the base plate approaches a central axis of the jet burner with increasing distance from the base plate such that the circumferential wall forms a diffuser to slow the cooling air provided by a compressor.

18. The jet burner as claimed in claim 16, wherein the cooling duct is adapted to be fed with the cooling air via an opening on a circumferential rim of the base plate.

19. A jet burner, comprising:

a base plate comprising a hot side disposed toward a combustion chamber and a cold side disposed away from the combustion chamber;

a pilot burner;

an annular cooling duct formed in the base plate between the hot gas and the cold side and comprising an inlet at a radially outer side of the base plate and a sole outlet only to the pilot burner; and multiple jet nozzles disposed about the pilot burner, each jet nozzle comprising a nozzle wall that penetrates the base plate and the annular cooling duct from the cold side to the hot side, thereby reducing a flow area of the annular cooling duct.

* * * * *